United States Patent [19]

Maestri

[11] 4,174,802

[45] Nov. 20, 1979

[54] MAGAZINE DEVICE FOR CONTINUOUSLY FEEDING NAILS INTO A NAIL DRIVING MACHINE

[76] Inventor: Bruno Maestri, Via Foppa, 26, Milano, Italy

[21] Appl. No.: 889,294

[22] Filed: Mar. 23, 1978

Related U.S. Application Data

[63] Continuation of Ser. No. 779,509, Mar. 21, 1977, abandoned.

[30] Foreign Application Priority Data

Mar. 24, 1976 [IT] Italy ..... 21544 A/76

[51] Int. Cl.[2] ..... B25C 3/00

[52] U.S. Cl. ..... 227/109; 206/338; 227/119; 227/127

[58] Field of Search ..... 227/109, 119, 127; 206/338

[56] References Cited

U.S. PATENT DOCUMENTS 3,720,364 3/1973 Maestri ..... 227/109

*Primary Examiner*—John McQuade

[57] ABSTRACT

A magazine for feeding nails into a nail driving machine is provided with means suitable for adjusting the nail guide passage towards the nail drive channel so as to accommodate nails of different lengths and diameters.

4 Claims, 5 Drawing Figures

MAGAZINE DEVICE FOR CONTINUOUSLY FEEDING NAILS INTO A NAIL DRIVING MACHINE

This is a continuation, of application Ser. No. 779,509, filed Mar. 21, 1977, now abandoned.

FIELD OF THE INVENTION

The present invention relates to an improved magazine device for continuously feeding nails into a nail driving machine.

The magazine device according to the present invention is of the type already disclosed in the applicant's prior U.S. Pat. No. 3,720,364 granted Mar. 13, 1973.

The magazine device which forms the subject matter of this invention relates more specifically to an improvement in the magazine device forming the subject matter of the above United States patent.

BACKGROUND OF THE INVENTION

In the magazine device forming the subject matter of the U.S. Pat. No. 3,720,364 the problem has been particularly solved of feeding into a nail driving machine nails of different lengths without resorting to the substitution of the magazine whenever the nail length is varied. This magazine, although presenting remarkable advantages already disclosed in the specification of the above-identified patent still suffered, however, from some limitations which are solved by the magazine which is the subject matter of the present invention.

A drawback presented by the magazine forming the subject matter of the foregoing patent was caused by the fact that movements of the nail points, even though of limited extent, might take place with respect to the inlet of the channel from which the nails are ejected. This happens particularly in the case of headed nails which are practically guided into the magazine only at the head thereof, whilst they are not guided at their points because the magazine presents a widened zone which permits limited movements of the nail points.

The above-mentioned drawback is further worsened by the fact that the inner surface of the magazine device is flat at said widened zone and, consequently, possible slippings of the nail points can not be avoided. This inner surface is formed by one of the faces of a slidable member which is removable with a view to inserting therein a nail strip or "load".

A further drawback presented by the magazine forming the subject matter of the above-identified patent is caused by the fact that the same magazine is suitable to permit feeding of nails having a diameter of a specified value. When the feeding of nails having different diameters is required, the substitution of the magazine is made necessary in order to maintain a proper operation of the machine. Particularly with a specified magazine, it is impossible to use nails having a diameter larger than that of the nails which the magazine is set to receive. In the case of nails having a smaller diameter, their feeding into the magazine is possible, however frequent jammings of the magazine can take place because the nails can move within the magazine. Indeed, the side surfaces of the nails do not any longer contact the inner guide walls of the magazine.

This latter drawback which happens with nails of smaller diameter obviously adds the first above-mentioned drawback, thus making it difficult using the magazine since it can be subjected to jamming.

SUMMARY OF THE INVENTION

The nail magazine for a nail driving machine which is the subject matter of the present invention, besides presenting the same advantages of the magazines of the above-identified patent, permits this latter drawback to be eliminated.

The magazine according to the present invention is therefore characterized in that the slidable member on which the nail points rest is provided with a longitudinally extending slot in which the nail points are inserted, thus providing a guide for the nails towards the nail drive channel and is moreover characterized in that the section of the nail passage towards the drive channel can be varied to match the diameter of the nails.

BRIEF DESCRIPTION OF THE DRAWINGS

The characteristics of the magazine device according to the present invention will become more evident from the following detailed description of a non-limiting embodiment thereof with reference to the attached drawings in which.

DESCRIPTION OF THE PREFERRED EMBODIMENT

Figure 1:
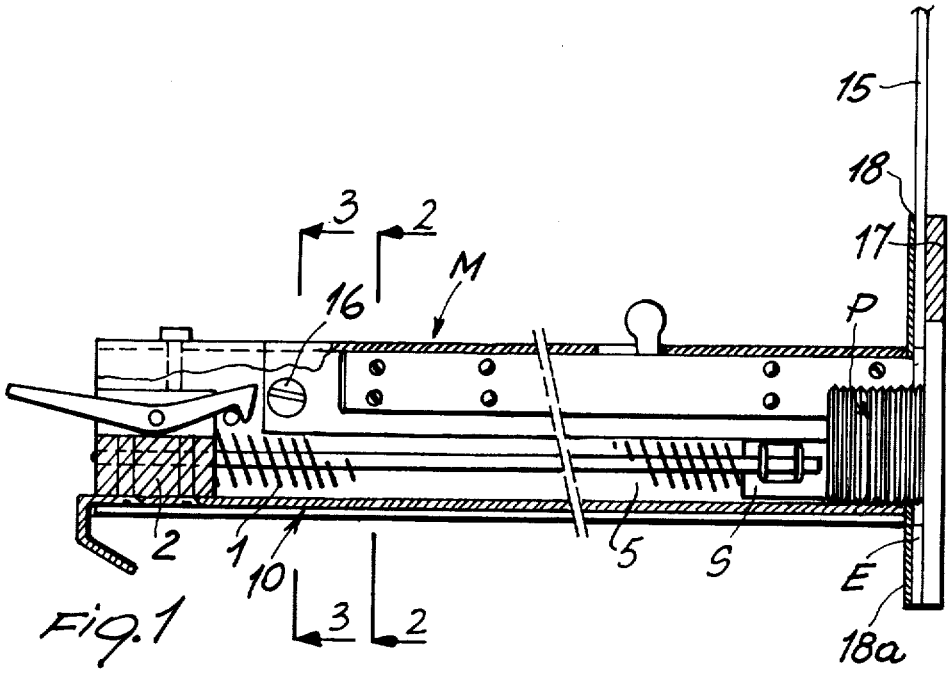
FIG. 1 shows a side view, partially broken away and with an opened side of the housing, feed and fastener unit of the magazine according to the present invention.

The detailed description given herebelow is specifically made with reference to the improvements; the detailed description of the whole magazine is omitted and only those elements which are useful for the understanding of the improvements are cited.

With reference to the figures, the magazine for feeding nails to a nail driving machine comprises a magazine M suitable for receiving a nail strip or "load" P which is pushed towards a drive channel E by a pusher member S cooperating with one end of a spring 1, the opposite end of which rests on a block 2 fixedly secured to the magazine frame. This latter consists essentially of a first side frame 3 and a second side frame 4 in overlapped relationship where the heads of the nails are placed and defining therebetween a guide passage 5 for the nails towards the drive channel E. Particularly, the first sideframe 3 consists of a substantially parallelepiped-shaped member, in the upper portion of which is provided a device C which permits nails of different lengths to be used. This device will not be described here because it has been disclosed in detail in the U.S. Pat. No. 3,720,364. The second side frame 4 is formed by a substantially U-shaped channel, bridge 6 of which forms the magazine cover, whereas the leg 7 constitutes one of the walls of the guide passage 5. Both the first side frame 3 and the leg 7 of the second side frame 4 are provided, on that side where the nail points rest with slots 8, 9, respectively, in which the edges of a slidable member 10 are slidably housed, which member consists of a shaped plate which forms the bottom of the magazine. The slidable member 10 has, at the zone where the points 11 of the nails 12 rest, a U-shaped portion 13 defining a longitudinally extending groove 14. The points 11 of the nails 12, move along the groove 14 as the nails move along the guide passage 5. This groove permits maintaining the nails 12 in constant parallel alignment to the inner faces of the side frames 3, 4, so that at the drive channel E, each nail 12 has its own longitudinal axis coinciding with the longitudinal axis of the fastener driver schematically shown and referenced with the numeral 15 in FIG. 1.

The magazine device according to the present invention, in order to permit nails having different diameters to be used, such as for instance nails with or without heads, is provided with means suitable for varying the relative position of the first side frame 3 to the second side frame 4 by any predetermined value.

Figure 4:
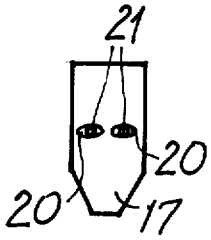
FIG. 4 is a schematic front view of the magazine showing the connecting plate permitting the adjustment of the nail passage.
Figure 3:
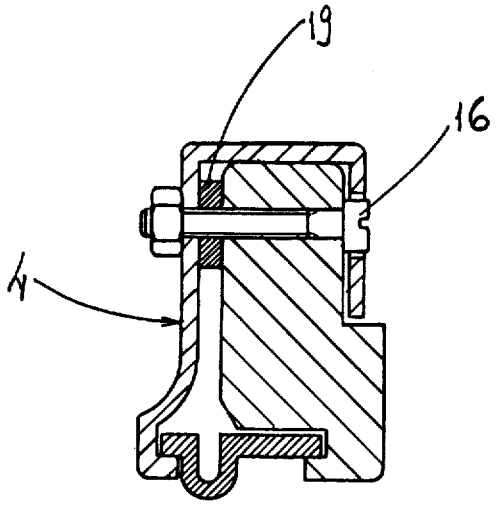
FIG. 3 is a view taken along section 3—3 of FIG. 1 illustrating the means for adjusting the nail passage to accommodate nails of different diameters.

As can be specifically noted in FIGS. 1, 3 and 4, the side frames 3, 4 are connected to each other at one end thereof by a screw 16, and at the opposite end by a shaped plate 17. This latter defines, with the extensions 18, 18*a* provided for on magazine M of the magazine device, a passage for the fastener driver 15 and the drive channel E, respectively.

In order to permit the relative movement to take place between the first side frame 3 and the second side frame 4, there is provided on the screw 16 a removable washer 19, placed between the inner walls of the first and second side frames 3, 4. Therefore, the washer 19 permits the distance between the side walls 3, 4 to be varied insofar as its thickness determines the extent to which the side frames 3, 4 can be spaced. Since the washer thickness is obviously known, is it possible for the space to be varied by using washers having different thicknesses. To this end, it is sufficient to unscrew the screw 16, thus extracting it from the frame of the magazine device, substitute the washer 19, and finally reinsert the screw 16 in the magazine. The foregoing adjustment must obviously be accompanied by a corresponding variation of the distance between the side frames 3, 4 at their end which is opposite to that where the screw 16 is provided. To this end, the plate 17 permits movements of the end of the side walls 3, 4 corresponding to those performed at the opposite end.

As viewed particularly in FIG. 4, the locking of plate 17 to the frame of the magazine device is accomplished via screws 21 inserted into holes 20 of the plate 17, which screws are then respectively inserted in frames 3, 4 to connect same. The holes 20 are specifically slots which permit the position of the ends of side frames 3, 4 to be adjusted in a way corresponding to the adjustement effected at the opposite end.

According to a further embodiment, which makes the use of the magazine by an operator simpler, a number of plates 17 with circular holes having different relative distances are provided. The spatial differences between the holes of the various plates 17 correspond to the various thicknesses of the washers 19 so that the operator can match any washer 19 and a corresponding plate in such a way as to obtain a perfect alignment of the side frames 3, 4. When the operator provides for the substitution of the washer 19 and plate 17, he must, correspondingly, substitute the slidable member 10 because this latter must always remain locked firmly within the grooves 8, 9 of the side frames 3, 4.

Figure 5:
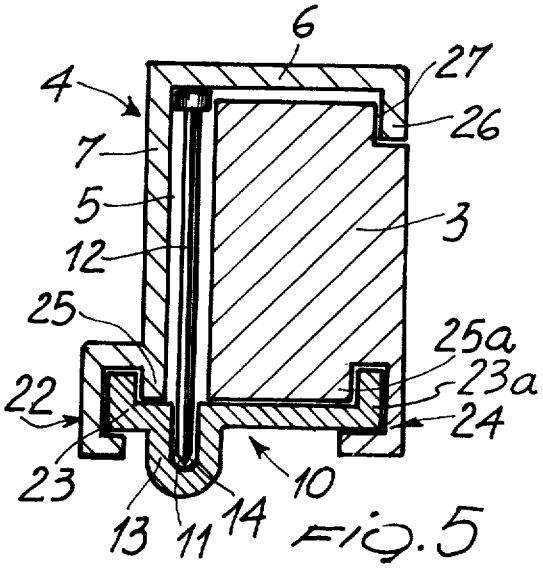
FIG. 5 shows a further embodiment, omitting certain parts which are shown in FIG. 2.

With specific reference to FIG. 5, there is shown a further embodiment in which the side frames 3, 4 can be arranged according to two distinct portions suitable for performing the feeding of headed nails and headless nails. As shown in FIG. 5, the relative position of the side frame 3 with respect to the side frame 4 is such as to permit loading headed nails.

According to this embodiment, the edge of the wall 7 of the side wall 4 and the end of the side wall 3 which are suitable for slidably housing the edges of the slidable member 10, are so contoured as to permit movements of the side walls 3, 4 between two positions, particularly a position corresponding to the largest distance for loading and guiding nails with leads and a position corresponding to the smallest distance for loading and guiding of headless nails. To this end, the wall 7 of the side frame 4 has, in the vicinity of the end suitable for receiving the edge of the slidable member 10, a substantially C-shaped extention 22 in which there is housed the edge 23 of the substantially L-shaped slidable member 10. The outer surface of the edge 23 of the slidable member 10 abuts, in the position of the smallest opening, on the inner wall of the extention 22 of the wall 7. Correspondingly, the outer surface of the opposite edge 23*a*, which is also L-shaped, rests on the inner surface of an extention 24 of the side frame 3, which extension is also substantially C-shaped.

In the position of the largest opening, the side frames 3, 4 are manually moved away from each other until the inner walls of the edges 23, 23*a* of movable member 10 abut on the corresponding protrusions 25, 25*a* of the side frames 3, 4.

In order to lock the side frames 3, 4 in any of the above mentioned positions, it is sufficient to provide a washer 19 having suitable thickness and, as shown in FIG. 4, slots 20 which permit adjusting at the forward portion the position of side frames 3, 4.

Figure 2:
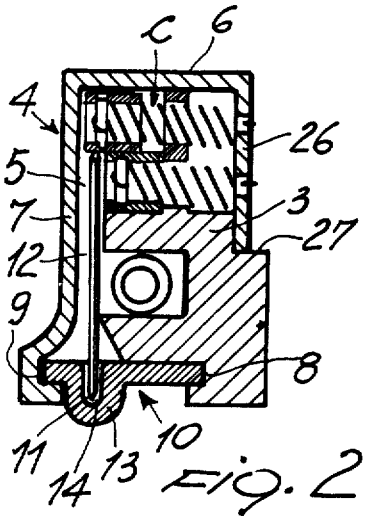
FIG. 2 is a view taken along section 2—2 of FIG. 1 which also shows a fastener which, however, would not actually be seen in this view.

It should be finally noted that the wall 26 of the side frame 4, opposite to wall 7, is in a back position with respect to the plane of the outer surface of the side frame 3. Besides, the length of the wall 26 is shorter than the length of the wall 7 as can be particularly viewed in FIGS. 2 and 5. At the zone where there is provided the device C (not shown in FIG. 5 since not part of the invention) for using nails of different length, the height of the wall 26 is about one-half of the wall 7 (FIG. 2), whilst in the remaining portion of the magazine the wall 26 substantially consists of an extension at right angles with respect to the other side (FIG. 5). The end of the wall 26 facing the side frame 3 is housed within a substantially L-shaped recess of the side frame 3 so as to permit movements of the side frame 4 to take place with respect to the side frame 3.

What is claimed is:

1. An improved magazine device for continuously feeding nails into a nail driving device comprising a first side frame and a second side frame defining therebetween a nail guide passage to guide the nails towards a drive channel, means for connecting and disconnecting said side frames from each other provided at the ends thereof, and a slidable member housed between said side frames to enable insertion of a nail strip into said guide passage, said slidable member being provided on its inner face facing the guide passage with a substantially longitudinal slot suitable for receiving the points of the nails, and said means for connecting and disconnecting said side frames from each other comprising means for adjusting the distance between said side frames and thereby said guide passage to accommodate nails of varying diameters.

2. An improved magazine device according to claim 1, wherein said slidable member comprises a plate removably housed between said side frames, and there are slots proficed in said side frames in which said plate is slidably fitted, said plate having in the zone engaged by the points of the nails a substantially U-shaped portion defining said longitudinal slot therein.

3. An improved magazine device according to claim 1, wherein the edges of said slidable member are substantially L-shaped, and said side frames have substantially C-shaped extensions in which said L-shaped edges are housed with clearance to permit adjustment of said side frames, the depth of said extensions being larger than the thickness of said edges of said slidable member.

4. An improved magazine device according to claim 1, wherein one of said side frames is a substantially U-shaped channel and arranged in overlapped relationship with respect to the other frame, one leg of said U-shaped channel being slidable in a L-shaped recess provided in said other frame in a manner so as to permit adjustment of said frames.

* * * * *